United States Patent [19]

Giertz

[11] 4,412,684

[45] Nov. 1, 1983

[54] LIQUID SEAL FOR CLOSING AN OPENING OF A REACTION VESSEL

[75] Inventor: Hans-Josef Giertz, Ratingen, Fed. Rep. of Germany

[73] Assignee: Bergwerksverband GmbH, Essen, Fed. Rep. of Germany

[21] Appl. No.: 252,131

[22] Filed: Apr. 8, 1981

[30] Foreign Application Priority Data

Apr. 9, 1980 [DE] Fed. Rep. of Germany ..... 3013650

[51] Int. Cl.[3] ..... F16J 15/40; C10B 25/16

[52] U.S. Cl. ..... 277/135; 202/248; 202/269; 277/15; 432/237

[58] Field of Search ..... 277/13, 14 R, 14 V, 277/15, 135, 226; 432/237; 202/247, 248, 269

[56] References Cited

U.S. PATENT DOCUMENTS

| | | | |
|---|---|---|---|
| 687,051 | 11/1901 | McConnell | 432/237 X |
| 1,918,860 | 7/1933 | Mintner | 202/269 X |
| 2,878,170 | 3/1959 | Forsans | 202/247 |
| 4,284,479 | 8/1981 | Schulte | 202/248 |

FOREIGN PATENT DOCUMENTS

| | | | |
|---|---|---|---|
| 906687 | 3/1954 | Fed. Rep. of Germany | 202/248 |
| 1037408 | 8/1958 | Fed. Rep. of Germany | 202/248 |
| 2548714 | 5/1977 | Fed. Rep. of Germany | 202/269 |
| 1233487 | 5/1971 | United Kingdom | 277/135 |

*Primary Examiner*—Robert S. Ward, Jr.
*Attorney, Agent, or Firm*—Michael J. Striker

[57] ABSTRACT

An arrangement for sealingly closing an opening of a reaction vessel includes a frame member which bounds the opening and a closing member which is movable between a closing position in juxtaposition with, and an opening position at a spacing from the frame member, as well as a sealing arrangement for sealing the gap between these members in the closing position of the closing member. The sealing arrangement includes an inner seal and an outer seal which define a sealing space filled with a preferably inert gaseous medium. The outer seal includes two sealing elements which extend across the gap in the closing position and define between themselves a confining space, and a liquid seal confined in this confining space. At the upper region, the liquid seal may be confined in an upwardly open horizontal channel and at the lower region it may be contained in a trough-shaped receptacle. The sealing liquid of the liquid seal is preferably circulated through the confining space to act as a cooling medium.

13 Claims, 6 Drawing Figures

LIQUID SEAL FOR CLOSING AN OPENING OF A REACTION VESSEL

BACKGROUND OF THE INVENTION

The present invention relates to an arrangement for sealingly closing an opening in general, and more particularly to an arrangement of this type which is suitable for use in connection with an inlet and/or outlet opening of a vessel having an internal space in which a chemical reaction or chemical reactions take place. Still more particularly, the closing arrangement according to the invention is suited for use at the charging and/or discharging opening of a coking oven.

There are already known closing arrangements of this kind which include a frame member on the vessel which bounds the opening and a closing member or door which is movable between a closing position in which it bounds a gap with the frame member and an opening position in which the closing member exposes the opening, wherein the closing member overlaps the frame member so that the aforementioned gap extends outwardly from the opening and wherein the sealing arrangement includes two sealing elements or blades which extend all around the opening with outward spacings from the latter as well as from one another in the closing position of the closing member, the sealing elements being mounted on one of the members and extending therefrom across the gap and into contact with the other member to define between themselves an enclosed sealing space which is filled with a gaseous medium.

Vessels equipped with this type of sealing and closing arrangement are customarily used in preference to vessels equipped with other types of sealing arrangements when the chemical reaction or reactions taking place in the internal space of the vessel require performance at, or result in the development of, high temperatures, and when the gases developing or liberated during the performance of such reaction or reactions can no longer be retained in the internal space of the vessel with a sufficient degree of reliability by resorting to the use of a simple sealing arrangement, so that such gases could escape past the simple sealing arrangement through the gap between the frame member and the closing member and constitute a burden to the environment or a hazard or nuisance to the operating personnel.

An environment in which the sealing arrangement of this type can be used in a particularly advantageous manner is that of a coking oven, particularly a coking oven the frame member and the closing member of which extend along a substantially vertical plane in the closing position of the closing member or door.

While it is true that, in the heretofore known embodiments of the sealing arrangements of the above-discussed type, it was possible to achieve the gap-tightness of the closing arrangement in the closing position with a high degree of reliability by resorting to the use of the aforementioned doubled sealing elements defining the sealing space therebetween, there was still present an important drawback, namely, that the materials usually selected for the sealing elements had a relatively short life span under the conditions of use thereof, that is, when exposed to the relatively high temperatures prevailing in the internal space of the vessel or at the vicinity of the opening. Also, the sealing action of the sealing arrangement was less then complete under many circumstances, especially when the sealing elements were constructed as relatively rigid sealing blades or similar elements, inasmuch as either the frame member or the closing member or both are likely to suffer deformations under the influence of the high temperatures, which varies the size or width of the gap, possibly to an extent where the sealing elements would not be able to compensate for such variations, and inasmuch as deposits or encrustations are likely to develop on the frame member or on the closing member around the opening, especially when the sealing arrangement is being used in a coking oven, where they would interfere with the ability of the sealing elements to contact the opposite member to that on which such sealing elements are mounted and hence let the potentially noxious or hazardous gases escape past the sealing elements through the interstices between the encrustations, the sealing elements, and the opposite member.

OBJECTS AND SUMMARY OF THE INVENTION

Accordingly, it is a general object of the present invention to avoid the disadvantages of the prior art.

More particularly, it is an object of the invention to provide a sealing and closing arrangement of the type here under consideration which is not possessed of the disadvantages of the prior-art arrangements of this type.

Still more particularly, it is an object of the present invention to develop a sealing arrangement including an inner and an outer seal which surround the opening to be closed in the closing position of the closing member and define an enclosed sealing space therebetween, wherein the outer seal assures gas-tightness of the sealing arrangement and remains effective for long periods of time even though exposed to high temperatures.

Yet another object of the invention is to so design the sealing arrangement as to be simple in construction, easy to manufacture and use, to require only a minimum amount of maintenance, and to be reliable nevertheless.

A further object of the present invention is to so construct the sealing arrangement that it will remain completely effective and functional even as the frame member and the closing member undergo temperature-related deformations.

In pursuance of these objects and others which will become apparent hereafter, one feature of the present invention resides in an arrangement for sealingly closing an opening, particularly of a vessel having an internal chamber for performing chemical reactions, therein, which arrangement, briefly stated, comprises a combination of a frame member surrounding the opening to be sealingly closed; a closing member movable between a closing position in which it bounds a gap with the frame member and an opening position in which it exposes the opening; and means for sealing the gap, including at least one sealing blade mounted on one of the members and extending across the gap into contact with the other member in the closing position of the closing member, and a liquid seal confined in the gap adjacent to the sealing blade around the entire perimeter of the opening in the closing position of the closing member. It is further advantageous when the closing member is so constructed as to overlap the frame member in the closing position thereof so that the gap extends outwardly from the opening between the frame member and the closing member, and when the sealing blade is outwardly spaced from the opening. Then, the liquid seal is advantageously confined in the gap at the outside of the sealing blade, and the sealing means further includes at least one additional sealing blade mounted on a first of the members and extending across the gap into contact with the second of the members in the closing position of the closing member, the additional sealing blade being situated inwardly of the aforementioned sealing blade and defining therewith an enclosed space in the gap around the opening to be sealingly closed in the closing position of the closing member. Preferably, the sealing means further includes at least one auxiliary sealing blade mounted on a selected one of the aforementioned members and extending across the gap outwardly of the first-mentioned sealing blade into contact with the respectively other member in the closing position to bound with such sealing blade a confining space in the gap for confining the liquid seal therein. The arrangement of the present invention further advantageously comprises means for supplying fresh or replenishment sealing liquid into the liquid seal, and means for withdrawing spent sealing liquid from the liquid seal.

When the closing member extends along a substantially vertical plane when in its closing position, the sealing blade, the frame member and the closing member are advantageously so configurated as to define with one another an upwardly open substantially horizontal channel at the upper region of the closing member, this channel being at least partially filled with a part of the liquid seal in the closing position of the closing member. Then, it is further advantageous when this channel is in free communication at its lateral ends with the lateral confining spaces for the liquid seal which are defined between the first-mentioned and the auxiliary sealing blades. It is also advantageous under these circumstances to leave the gap downwardly open at the lower region of the substantially vertically extending closing member, and to provide a trough-shaped receptacle as a constituent part of the sealing means at the lower region of the closing member, the receptacle being filled with a portion of the liquid seal to a level above the lower face of the closing member in the closing position of the latter so that the sealing liquid penetrates from below into the previously downwardly open lower portion of the gap and the upper surface thereof forms a lower boundary of a bottom portion of the sealing space which communicates with the lateral portions of the sealing space at the lateral regions of the closing member. An advantageous embodiment of the present invention is obtained when the confining spaces arranged at the lateral regions of the closing member communicate with the liquid seal portion accommodated in the receptacle below the upper surface of this liquid seal portion, and when throttling means is provided in the lateral confining spaces below the upper surface of the liquid seal portion accommodated in the receptacle. These two expedients, that is, the provision of the upwardly open channel at the upper region of the closing member, and the provision of the trough-shaped receptacle at the lower region of the closing member, can be used individually or in combination with one another. In any event, each of these expedients contributes to the simplification of construction and operation of the arrangement in accordance with the present invention.

When it is expected that the sealing blade and/or the auxiliary sealing blade will be subjected to very high temperatures, the mounting means which mounts the sealing blade and the auxiliary sealing blade on the one member are so constructed as to include thermally insulating means interposed between said blades and the one member.

In the event that it is likely that the existence of the high temperatures in the internal space of the vessel or at the region of the closing arrangement will cause either the frame member or the closing member to become deformed, as it can happen, for instance, in closing arrangements of coking ovens, and thus will prevent or render less reliable the sealing contact of the sealing blades with the two members, and particularly with the member opposite to the member on which the sealing blades are mounted, it is advantageous, in accordance with another aspect of the present invention, to so construct the mounting means for at least the sealing blade, but preferably also for the auxiliary sealing blade that said sealing blade or blades are elastically yieldably mounted on the one member, and to provide means for urging said sealing blade or blades toward the other member.

For those instances or applications where it is possible that an explosive mixture would form in the sealing space between the first-mentioned sealing blade and the additional sealing blade, it is further proposed, in accordance with a further facet of the invention, to fill this sealing space with an inert gasous medium. The presence of this gaseous medium in the sealing space will prevent penetration of gases capable of forming the explosive mixture into the sealing space even if the additional sealing blade which delimits this sealing space at the side of the opening achieves less than perfect sealing effect. In this connection, it is advantageous to provide means for supplying the inert gaseous medium into the sealing space and preferably also means for discharging the inert gaseous medium from the sealing space. However, a particularly simple realization of this concept is obtained when vapor of the sealing liquid, such as water steam when the sealing liquid is water, is being used as the inert gaseous medium, particularly since it is not necessary to provide any additional supplying means; rather, the vapor or steam is admitted into the sealing space directly from the confining space, in many instances, without any need for special measures since the vapor or steam can enter the sealing space past the sealing element or blade, or leakage amounts of the sealing liquid may enter the sealing space in this manner and evaporate therein to form the inert gaseous medium.

The novel features which are considered as characteristic of the invention are set forth in particular in the appended claims. The improved arrangement itself, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
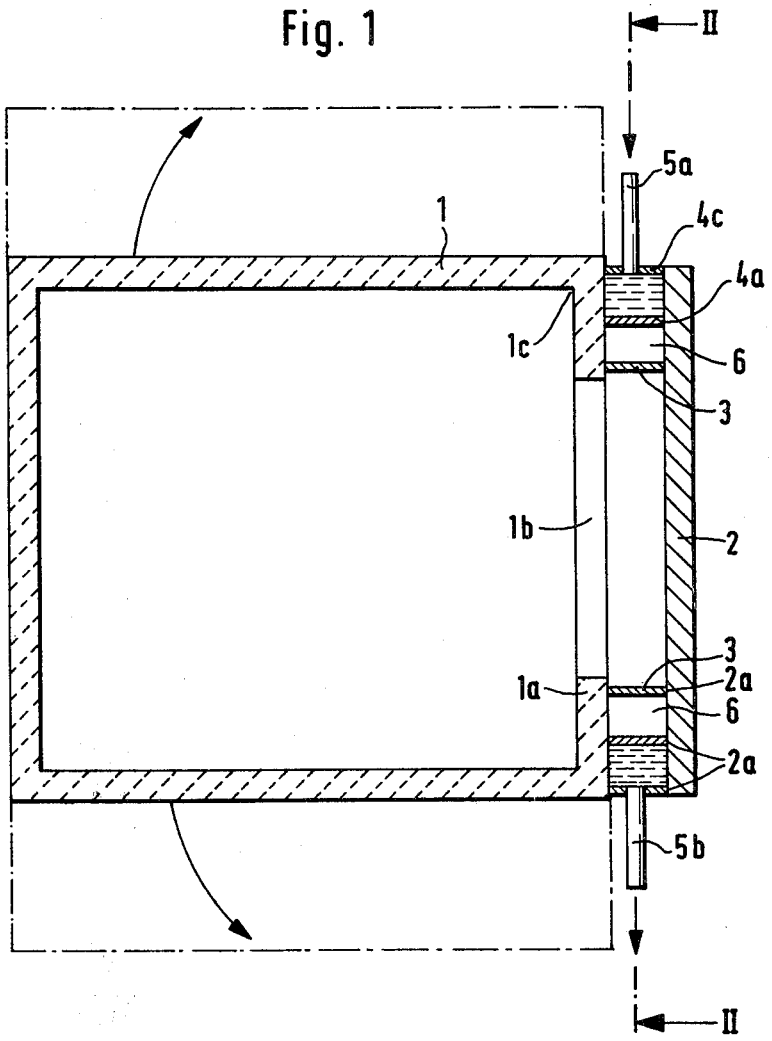
FIG. 1 is a diagrammatic vertical cross-sectional view of a reaction vessel equipped with the closing and sealing arrangement according to the present invention.

Referring now to the drawing in detail, and first to FIG. 1, thereof, it may be seen that the reference numeral 1 has been used to identify a reaction vessel in its entirety, that is, a vessel having an internal space or chamber in which chemical reaction or reactions may be performed or may take place while the vessel is in use. The vessel 1 has a frame member 1*a*, which may be separate from the remainder of the vessel 1 but rigidly mounted thereon, or integral with the remainder of the vessel, as shown in FIG. 1. The frame member 1*a* bounds an opening 1*b* which is to be sealingly closed during the operation of the vessel 1. In order to close the opening 1*a*, there is provided a closing member or door 2 which is movable toward and away from the frame member 1*a* between its open position in which it exposes the opening 1*a* and its closed position as shown in FIG. 1 in which it overlaps the frame member 1*a* and bounds therewith a gap which extends outwardly from the opening 1*a* between the frame member 1*a* and the closing member 2.

A sealing arrangement is arranged between the frame member 1*a* and the closing member 2, this sealing arrangement including and inner seal including a sealing element or blade 3, and an outer seal including a sealing blade or element 4*a*, an auxiliary sealing element or blade 4*c*, and a liquid seal 4*b* filling the confining space delimited in the gap between the frame member 1*a* and the closing member 2 by the sealing blade 4*a* and the auxiliary sealing blade 4*c*, when the closing member 2 is in its closing position.

The sealing blades 3, 4*a* and 4*c* may be mounted, in a conventional manner which has not been shown in any detail in the drawing, either on the closing member 2 at regions 2*a* in which event they extend across the gap and contact the frame member 1*a* at regions 1*c*, or on the frame member 1*a* at regions 1*c* in which event they extend across the gap and contact the closing member 2 at regions 2*a*, in the closing position of the closing member 2. However, it is also possible to mount some of the sealing blades 3, 4*a* and 4*c* on one of the members 1*a*, 2 and the remainder of the sealing blades, 3, 4*a* and 4*c* on the other member 2, 1*a*. The sealing blades 3 and 4*a* bound with one another a sealing space 6 in the gap between the members 1*a*, 2 in the closing position of the closing member 2. When the sealing blades 3, 4*a* and 4*c* are all mounted on one of the members 2, 1*a*, they merely bound open channels when the closing member 2 is in its open position, these channels being closed by the other member 1*a*, 2 only in the closing position of the closing member 2. It is immaterial for the purposes of the present invention how the closing member 2 is movable between its open and closed position so long as it is understood that the closing member 2 is retained in its close position relative to the frame member 1*a* during the operation of the vessel 1. However, it may be mentioned that the closing member 2 could be connected to the frame member 1*a* by hinges or conventional construction which could be arranged at one of the lateral regions of the closing member 2 and of the frame member 1*a*, and that convention latching or arresting means could be provided, for instance, at the other lateral region to hold the closing member 2 in its closing position.

It will be appreciated that, in view of the open construction of the channels between the sealing blades 3, 4*a* and 4*c* in the open position of the closing member 2, the liquid constituting the liquid seal 4*b* in the closing position of the closing member 2 must be discharged from the confining space between the sealing blades 4*a* and 4*c* prior to the movement of the closing member 2 toward its open position, and fresh sealing liquid must be admitted into the confining space between the sealing blades 4*a* and 4*c* after the return of the closing member 2 to its closing position. To achieve this, there are provided an inlet conduit 5*a* and an outlet conduit 5*b* which communicate with the confining space between the sealing blades 4*a* and 4*c* at least in the closing position of the closing member 2 and through which the sealing liquid can be admitted into the confining space to constitute the liquid seal 4*b* therein, or discharged from such confining space. It is also possible to provide an outlet valve in or at the entrance of the outlet conduit 5*b* and to so adjust the throughput of this outlet valve that, in the closing position of the closing member 2, some of the sealing liquid will flow through the outlet valve and through the outlet conduit 5*b* while the amount of the liquid constituting the liquid seal 4*b* is replenished at the same rate through the inlet conduit 5*a*. This has the advantage that, when the outer seal 4*a*, 4*b* and 4*c* is subjected to high temperatures, as it is, for instance, in a coking oven, the sealing liquid will not become unduly heated during its passage through the confining space prior to its discharge therefrom through the outlet conduit 5*b*. Also, when some of the sealing liquid escapes from the confining space past one or both of the sealing blades 4*a*and 4*c*, the integrity of the liquid seal 4*b* can be maintained by supplying the replenishing sealing liquid at a rate which exceeds that at which the sealing liquid is discharged through the outlet conduit 5*b* by the amount of the leakage. Under these circumstances, the sealing liquid constitutes not only the liquid seal 4*b*, but also a cooling for the surrounding areas.

Figure 2A:
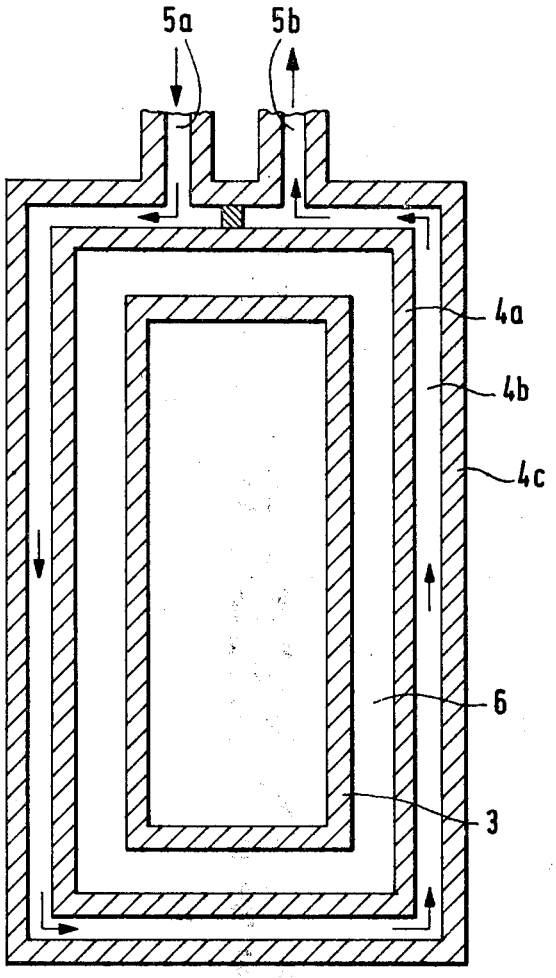
FIG. 2*a* is a sectional view taken along the line II—II of FIG. 1, but showing a modification of the sealing arrangement.

FIG. 2*a* depicts a modification of the basic concept of the present invention, wherein the sealing space has a closed ring-shaped configuration, while the confining space which accommodates the liquid seal 4*b* in the closed position of the closing member 2 surrounds the sealing space 6 at he outside and communicates with the inlet conduit 5*a* and with the outlet conduit 5*b*, both of which are arranged at the upper region of the sealingly closing arrangement. It is also possible in this modification to take similar steps as discussed above in order to obtain flow of the sealing liquid through the confining space, except that it is not necessary to provide the outlet valve because of the arrangement of the outlet conduit 5*b* at the upper region of the sealingly closing arrangement.

In the event that some of the sealing liquid of the liquid seal leaks past the sealing blades 4*a*, 4*c*, it is generally harmless since the amount of the sealing liquid in the confining space is being constantly replenished through the inlet conduit 5*a* and the sealing blade 3 prevents the leakage liquid from reaching the opening 1*b* and through the same the interior of the vessel 1 where it could otherwise interfere with the proper performance of the chemical reaction, such as the coking reaction.

Figure 2B:
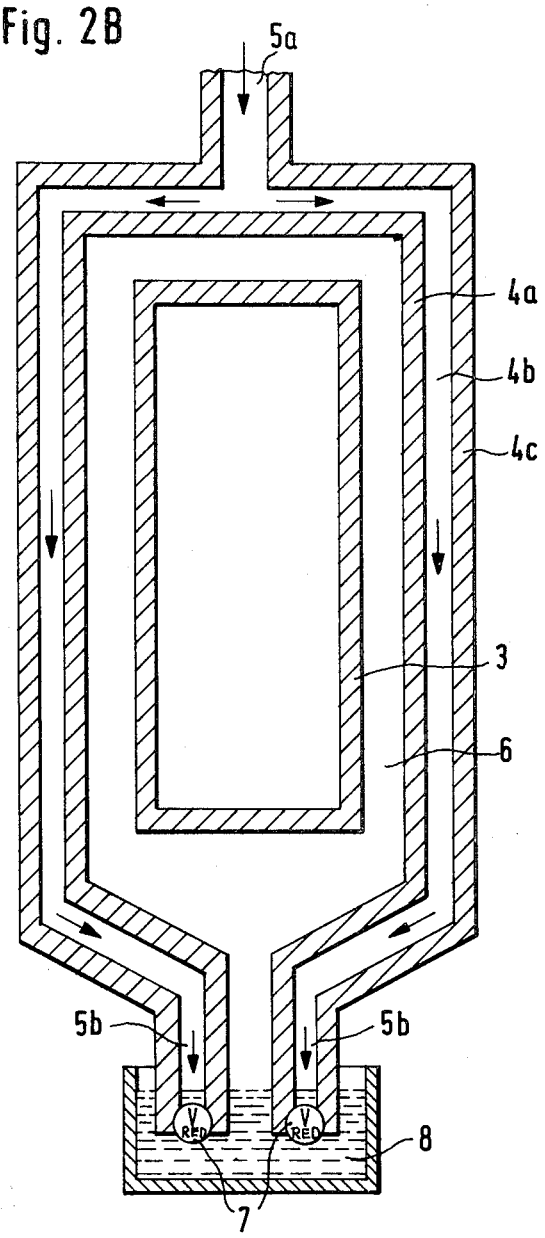
FIG. 2*b* is a view similar to that of FIG. 2*a*, but showing a further modification of the sealing arrangement.

The modification illustrated in FIG. 2*b* is similar to that of FIG. 2*a*, except that the outlet for the sealing liquid is arranged at the lower region of the closing member 2, as it is in FIG. 1. The flow of the sealing liquid through the confining spaces is controlled by respective valves 7 or similar throttling means or flow restrictors. Furthermore, the gap between the members 1*a*, 2 is downwardly open at the lower region of the closing member 2, and so is the sealing space 6. A trough-shaped receptacle 8 is arranged at the lower region of the sealing arrangement which collects the sealing liquid and the upper surface of which constitutes the lower boundary of the sealing space 6, while the liquid accumulated in the receptacle constitutes a portion of the liquid seal 6. Because of the downwardly open construction of the sealing space, any liquid which may have leaked into the sealing space 6 flows into the receptacle 8 as well.

Figure 3A:
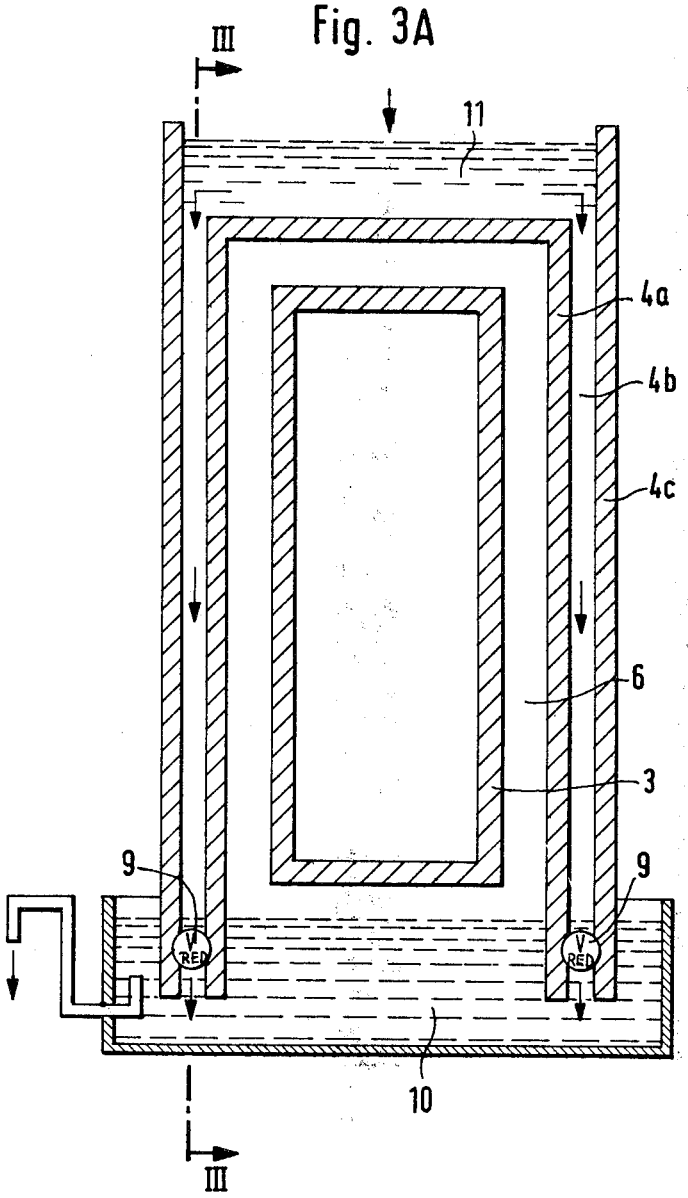
FIG. 3*a* is a view similar to those of FIGS. 2*a* and 2*b*, but showing still another modification of the sealing arrangement.

FIG. 3*a* shows a further modification of the basic concept of the present invention, wherein the means for confining the liquid seal 6 is configurated as an upwardly open channel at the upper region of the closing member 2. This is a simplified version of the modification of FIG. 2*a*, wherein the auxiliary sealing blade delimiting the confining space for the liquid seal 6 from above at the upper region of the closing element or member 2 has been omitted. This modification can only be used when the closing member 2 extends along a substantially vertical plane when in its closing position, since the sealing liquid would otherwise flow out of the open channel. This modification has the advantage that a supply trough, which is known from various applications and is if a conventional construction, can be used, and its filling state can be maintained by a weir or by a float valve so that its upper surface is maintained at substantially constant level. An overfilling can be avoided, for instance, by resorting to the use of a conventional overflow system.

FIG. 3*a* also illustrates a special construction of the sealing arrangement at the lower region of the closing member 2. A receptacle 10 is either filled to such a level, or lifted to such an elevation that the liquid contained therein penetrates into the gap between the closing member 2 and the frame member 1*a* from below and establishes an upper surface in the gap which then constitutes the lower boundary of the otherwise downwardly open sealing space 6. The lower ends of the outer seal 4*a*, 4*b* and 4*c* are submerged in the sealing liquid contained in the receptacle 10 to such an extent that regulating valves 9 incorporated therein are situated underneath the upper surface of the sealing liquid in the receptacle 10. This is necessary in order to insure that the confining space of the outer seal 4*a*, 4*b*, 4*c* is completely filled with the sealing liquid after the closing member 2 has been moved into its closing position. Prior to the movement of the closing member 2 toward its opening position, the sealing liquid is to be again discharged from the confining space, which can be accomplished, for instance, in that the supply of the replenishment liquid is discontinued so that the sealing liquid present in the confining spaces can flow through the valves 9 into the receptacle 10, which is then removed from the frame member 1*a*, either by lowering or by tilting the same, to such an extent that the closing member 2 can be moved toward its open position without any interference from the receptacle 10.

This solution has the advantage that pollutants, the sealing liquid which has leaked out of the confining spaces, or condensates which have escaped from the internal chamber of the vessel 1 despite the presence of the sealing blade 3 can be removed without encountering any difficulty. When the sealingly closing arrangement of the present invention is being used for closing the opening of a coking oven, the encrustations which often develop at this region and which especially burden the outer seal 4*a*, 4*b* and 4*c* do not form any longer at this region.

Figure 3B:
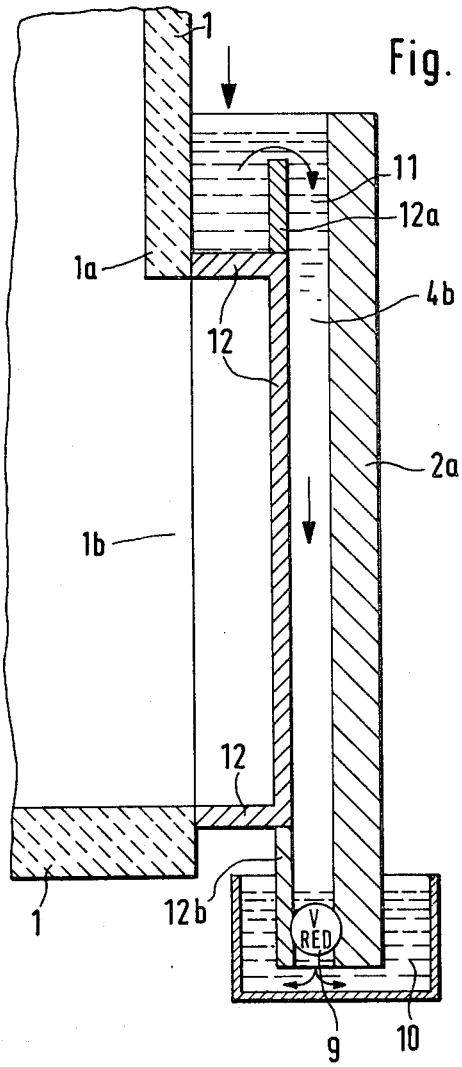
FIG. 3*b* is a sectional view taken along the line III—III of FIG. 3*a*.

It is shown in FIG. 3*b* that a specially constructed frame 12, 12*a*, 12*b* is being used at the opening 1*a* of the vessel 1. The portion 12*a* of this frame forms a horizontally extending weir for a water reservoir, from which liquid constantly flows over the weir or portion 12*a* into a horizontal channel 11. The portion 12*b* of this frame is constructed as a horizontally extending shoulder which is contacted by the sealing blade 3 and which extnds into the receptacle 10 to approximately the same extent as the two vertically extending lateral portions of the confining space accommodating the liquid seal 4*b*.

This solution offers the advantage that a superatmospheric pressure which may develop as a result of a malfunction in the sealing space 6 or an elevated pressure which may develop in the lateral confining spaces for the liquid space 4*b* can rise only to the extent corresponding to the weight of the column of the sealing liquid penetrating into the gap between the shoulder 12*b* and the closing member 2 and thus to the degree of penetration of the shoulder 12*b* into the receptacle 10.

Even here, the sealing liquid constituting the liquid seal 4*b* can be circulated in the respective confining spaces so long as the degree of contamination thereof does not exceed an acceptable level.

Figure 4:
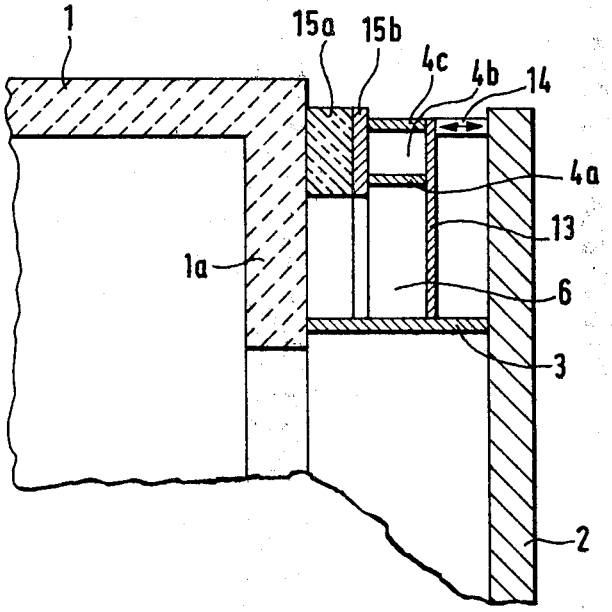
FIG. 4 is a view similar to that of FIG. 3*b*, but showing only a portion thereof in yet another modification of the sealing arrangement.

The upper region of the sealing arrangement embodying a further modification of the basic concept of the invention is shown at an enlarged scale in FIG. 4. Herein, there is provided an elastically yieldable wall 13 which performs the function which, in the previously discussed modifications, is performed by the closing member 2 itself, that is, it constitutes the boundaries of the sealing space 6 and of the confining space which accommodates the liquid seal 4*b* at the side of the closing member 2. Only diagrammatically indicated biassing means 14 of conventional construction, such as springs, in conjunction with the inherent elasticity of the wall 13, urge the sealing blades 4*a*, 4*c* of the outer seal 4*a*, 4*b*, 4*c* toward the frame member 1*a*. In this manner, it is achieved that the sealing blades 4*a*, 4*b* and 4*c* contact corresponding sealing regions 15*b* of a bearing member 15*a* mounted on the frame member 1*a* even if the frame member 1*a* has been deformed as a result of the influence of high temperatures. The inner sealing element 3 can be constructed and mounted in a manner customary in coking ovens as a positionally adjustable blade-shaped sealing element.

The present invention can be employed in a particularly effective manner when the sealing space 6 is filled with an inert gaseous medium, or when such inert gaseous medium is caused to flow through the sealing space 6. When this expedient is resorted to, the inert gaseous medium in the sealing space 6 performs an additional sealing function, so long as the pressure of the inert gaseous medium exceeds the pressure prevailing in the internal chamber of the vessel 1 and thus in the opening 1*b*. In addition thereto, the presence of the inert gaseous medium in the sealing space 6 avoids the possibility of formation of an explosive or combustible mixture in the sealing space 6 or in the opening 1*b*, as well as the possibility of condensate deposits in the sealing space 6. This problem is particularly pronounced when the sealing arrangement of the doubleseal type is used for sealing the gap between the door and the frame of a coking oven. It has been found that the vapors or steam of the customarily used sealing liquids, such as, for instance, water, are suited for use as the inert gaseous medium. Such a solution brings about the particular advantage that the possibly occurring leakage of the sealing liquid into the sealing space 6 does not result in any deleterious consequences; rather, quite to the contrary, the leaking liquid, by evaporating at the hot surfaces bounding the sealing space 6, serves for increasing the contents of, and freshening, the inert gaseous medium in the sealing space 6. Of course, it is also possible, and in many instances desirable, to increase the amount of the inert gaseous medium in the sealing space either by admitting such gaseous medium into the sealing space, or by injecting a preferably pre-heated controlled amount of the sealing liquid into the sealing space 6 where the inert gaseous medium is then formed as a result of evaporation from the injected sealing liquid.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. An arrangement for sealingly closing an opening, particularly of a vessel having an internal chamber for performing chemical reactions therein, comprising, in combination, a frame member surrounding said opening; a closing member movable between a closing position in which it bounds a gap with said frame member and an opening position in which it exposes said opening; means for sealing said gap, including at least one sealing blade mounted on one of said members and extending across said gap into contact with the other member in said closing position, and a liquid seal confined in said gap adjacent to said sealing blade around the entire perimeter of said opening in said closing position; said closing member overlapping said frame member in said closing position so that said gap extends outwardly from said opening between said frame member and said closing member; said sealing blade being outwardly spaced from said opening; said liquid seal being confined in said gap at the outside of said sealing blade; said sealing means further including at least one additional sealing blade mounted on a first of said members and extending across said gap into contact with the second of said members in said closing position, and said additional sealing blade being situated inwardly of said sealing blade and defining with the latter an enclosed sealing space in said gap all around said opening.

2. An arrangement as defined in claim 1, wherein said sealing means further includes at least one auxiliary sealing blade mounted on a selected one of said members and extending across said gap outwardly of said sealing blade into contact with the respectively other member in said closing position to bound with said sealing blade a confining space in said gap for confining said liquid seal therein.

3. An arrangement as defined in claim 1; and further comprising means for supplying fresh sealing liquid to said liquid seal; and means for withdrawing spent sealing liquid from said liquid seal.

4. An arrangement as defined in claim 1, wherein said closing member extends along a substantially vertical plane in said closing position thereof; and wherein said sealing blade, said frame member, and said closing member define with one another an upwardly open substantially horizontal channel at the upper region of said closing member, said channel being at least partially filled with a portion of said liquid seal.

5. An arrangement as defined in claim 4, wherein said sealing means defines an enclosed confining space for the liquid seal at each of the lateral portions of said closing member, said confining spaces freely communicating with said channel at the lateral ends of the latter.

6. An arrangement for sealingly closing an opening, particularly of a vessel having an internal chamber for performing chemical reactions therein, comprising, in combination, a frame member surrounding said opening; a closing member movable between a closing position in which it bounds a gap with said frame member and an opening position in which it exposes said opening; means for sealing said gap, including at least one sealing blade mounted on one of said members and extending across said gap into contact with the other member in said closing positions, and a liquid seal confined in said gap adjacent to said sealing blade around the entire perimeter of said opening in said closing position; said closing member overlapping said frame member in said closing position so that said gap extends outwardly from said opening between said frame member and said closing member; said sealing blade being outwardly spaced from said opening; said closing member extending along a substantially vertical plane in said closing position thereof; said sealing means defining a confining space for the liquid seal at the outer side, and a sealing space at the inner side, of said sealing blade at the lateral and upper regions of the closing member while said gap is downwardly open at the lower region of said closing member; and wherein said sealing means further includes a substantially horizontal trough-shaped receptacle situated at the lower region of said closing member and filled with a portion of said liquid seal to a level above the lower face of said closing member in said closing position of the latter so that the upper level of the liquid seal forms a lower boundary of a further sealing space at the bottom region of said closing member communicating with said sealing space at the lateral regions of said closing member.

7. An arrangement as defined in claim 6, wherein the lateral portions of said confining space communicate with said liquid seal portion accomodated in said receptacle below said level.

8. An arrangement as defined in claim 7; and further comprising throttling means in the lateral portions of said confining space below said level.

9. An arrangement as defined in claim 6, wherein said sealing means further includes at least one auxiliary sealing blade; and further comprising means for mounting said sealing blade and said auxiliary sealing blade on said one member such that said auxiliary sealing blade is situated outwardly from said sealing blade and defines therewith a confining space in said gap for said liquid seal, including means for thermally insulating said blades from said one member.

10. An arrangement as defined in claim 1; further comprising means for elastically mounting at least said sealing blade of said sealing means on said one member; and means for urging said sealing blade toward said other member.

11. An arrangement as defined in claim 1, wherein said sealing means defines a sealing space in said gap at the inner side of said sealing blade, said sealing space accommodating an inert gaseous medium.

12. An arrangement as defined in claim 11; and further comprising means for supplying the inert gaseous medium into and for discharging the same from said sealing space.

13. An arrangement as defined in claim 11, wherein said inert gaseous medium is a vapor of the liquid of the liquid seal.

* * * * *